US011846124B2

(12) United States Patent
Angott et al.

(10) Patent No.: US 11,846,124 B2
(45) Date of Patent: Dec. 19, 2023

(54) LOCKING ASSEMBLY

(71) Applicant: Techlok Solutions, LLC, Royal Oak, MI (US)

(72) Inventors: Ryan J. Angott, Royal Oak, MI (US); Paul G. Angott, Bloomfield Hills, MI (US); Michael A. Latcha, Redford, MI (US)

(73) Assignee: TECHLOK SOLUTIONS, LLC, Royal Oak, MI (US)

( * ) Notice: Subject to any disclaimer, the term of this patent is extended or adjusted under 35 U.S.C. 154(b) by 0 days.

(21) Appl. No.: 17/409,072

(22) Filed: Aug. 23, 2021

(65) Prior Publication Data

US 2021/0381283 A1 Dec. 9, 2021

Related U.S. Application Data

(63) Continuation of application No. 16/924,448, filed on Jul. 9, 2020, now Pat. No. 11,105,124.

(60) Provisional application No. 62/871,764, filed on Jul. 9, 2019.

(51) Int. Cl.

| | |
|---|---|
| ***E05B 73/00*** | (2006.01) |
| ***B25B 5/06*** | (2006.01) |
| ***B25B 5/16*** | (2006.01) |
| ***B25B 5/10*** | (2006.01) |
| ***G08B 13/14*** | (2006.01) |

(52) U.S. Cl.

CPC ..... *E05B 73/0082* (2013.01); *B25B 5/068* (2013.01); *B25B 5/163* (2013.01); *B25B 5/166* (2013.01); *B25B 5/102* (2013.01); *G08B 13/14* (2013.01)

(58) Field of Classification Search

CPC ..... B25B 5/163; B25B 5/102; B25B 5/166; B25B 5/068; E05B 73/0082; A47B 2097/006; G08B 13/14; Y10T 70/5009

USPC ..... 269/166, 170; 70/57.1, 278.1, 280

See application file for complete search history.

(56) References Cited

U.S. PATENT DOCUMENTS

| | | | | |
|---|---|---|---|---|
| 4,570,465 | A * | 2/1986 | Bennett | E05B 73/0005 70/18 |
| 4,691,907 | A * | 9/1987 | Yang | B25B 5/003 269/152 |
| 5,427,364 | A * | 6/1995 | Zborschil | B25B 5/102 269/166 |
| 5,595,074 | A | 1/1997 | Munro | |

(Continued)

FOREIGN PATENT DOCUMENTS

FR 2674563 A1 10/1992

*Primary Examiner* — Eric J Rosen
*Assistant Examiner* — J Stephen Taylor
(74) *Attorney, Agent, or Firm* — Dickinson Wright PLLC

(57) ABSTRACT

A locking assembly for locking a portable electronic device to a work surface. The locking assembly comprises a clamp assembly including an elongated bar that extends between a first end and a second end. The clamp assembly further includes a first jaw and a second jaw movable along the elongated bar for clamping to a work surface between the first and second jaws. A connector extends from a first connector end that is pivotally connected to the locking assembly to a second end that can be connected to the portable electronic device. The connector securing the portable electronic device to the work surface while permitting it to pivot with respect to the locking assembly.

14 Claims, 20 Drawing Sheets

(56) References Cited

U.S. PATENT DOCUMENTS

| | | | | |
|---|---|---|---|---|
| 5,709,110 | A * | 1/1998 | Greenfield | E05B 73/0005 248/553 |
| 7,499,269 | B2 | 3/2009 | Allen | |
| 8,837,144 | B1 | 9/2014 | Allen | |
| 9,103,142 | B2 | 8/2015 | Abdollahzadeh et al. | |
| 9,598,883 | B1 * | 3/2017 | Avganim | E05B 73/0082 |
| 2007/0007704 | A1 * | 1/2007 | Hooper | B25B 1/103 269/246 |
| 2010/0079285 | A1 | 4/2010 | Fawcett et al. | |
| 2014/0259568 | A1 * | 9/2014 | Trotsky | B25B 5/166 24/523 |
| 2018/0347237 | A1 | 12/2018 | Tse et al. | |

* cited by examiner

LOCKING ASSEMBLY

CROSS-REFERENCE TO RELATED APPLICATION

This U.S. patent application is a continuation of U.S. patent application Ser. No. 16/924,448 filed on Jul. 9, 2020, which claims priority to and the benefit of U.S. Provisional Application No. 62/871,764 filed on Jul. 9, 2019, the entire disclosure of which is incorporated herein by reference.

BACKGROUND OF THE INVENTION

1. Field of the Invention

The present invention relates to a locking assembly. More particularly, the present invention relates to a locking assembly for securing an unsupervised portable electronic device or other personal belongings to a work surface.

2. Related Art

This section provides background information related to the present disclosure which is not necessarily prior art.

Since the introduction of the internet age, more opportunities have become available for persons to work remotely. With this availability, it has become a common practice to take and use portable electronic devices, such as laptops, in public places. For example, users of these portable electronic devices frequent coffee shops, airports, and bookstores as quiet public locations in which they can focus on work and/or other usages of their portable electronic devices. Once situated, however, it can be difficult for the user to use a restroom or purchase refreshments without leaving their portable electronic device unattended and vulnerable to theft. In fact, occurrences of theft have become so common that many shops and stores have started displaying signs warning clientele not to leave their portable electronic devices unattended.

In response to the rampant theft of unsupervised portable electronic devices, locking devices have been developed to allow the user to lock their portable electronic device during periods without supervision. These prior art locking devices are typically designed to lock a portable electronic device to a table or other work surface for deterring and reducing theft. However, despite some success, the prior art locking devices still exhibit common shortcomings. For example, prior art locking devices have struggled to provide a "one-size-fits-all" solution. More specifically, the prior art locking devices can only be used with portable electronic devices and work surfaces having very specific dimensions and configurations, and deviation from these dimensions and configurations result in damage to a work surface when trying to lock a non-compliant portable electronic device. In addition, prior art locking devices oftentimes employ rigid clamping mechanisms that are both cumbersome and relatively easy to compromise with simple tools or by simply repeated wiggling and pulling on the clamping mechanism. Other prior art locking devices use variations of locking ports (such as Kensington ports), which are integrated in some older generations of laptops but are also relatively easy to circumvent.

Accordingly, there is a continuing need to develop and further refine locking devices that are compatible with a variety of portable electronic devices and are less prone to being circumvented.

SUMMARY OF THE INVENTION

This section provides a general summary of the disclosure and is not to be interpreted as a complete and comprehensive listing of all of the objects, aspects, features and advantages associated with the present disclosure.

The subject invention is directed to a locking assembly for locking a portable electronic device to a work surface. The locking assembly includes a clamp assembly having an elongated bar extending between a first end and a second end and a first jaw and a second jaw, with at least one of the first jaw or the second jaw movable along the elongated bar between the first end and the second end for clamping a work surface between the first and second jaws. A locking mechanism is further included for selectively locking the relative positioning between the first jaw and the second jaw (i.e., securing the work surface between the first and second jaws in an un-movable/locked condition). The locking assembly further includes a connector extending from a first connector end pivotally connected to one of the clamp assembly or locking mechanism to a second connector end for connection to a provided portable electronic device. The connector thus secures the portable electronic device to the work surface while permitting the portable electronic device to pivot with respect to the locking assembly while locked thereto. In use, the second connector end is intended to be connected to the portable electronic device which a user desires to secure or lock to the locking assembly and the first connector end can be quickly locked and unlocked from the locking assembly for quick and efficient use.

In accordance with another aspect, the subject invention is directed to locking assembly for locking a portable electronic device to a work surface. The locking assembly includes a clamp assembly having an elongated bar extending between a first end and a second end and a first jaw and a second jaw, with at least one of the first jaw or the second jaw movable along the elongated bar between the first end and the second end for clamping a work surface between the first and second jaws. A locking mechanism is further included for selectively locking the relative positioning between the first jaw and the second jaw (i.e., securing the work surface between the first and second jaws in an un-movable/locked condition). Movement of the locking mechanism results in movement of the first jaw or the second jaw into forceful contact with the work surface. The clamp assembly can therefore be quickly and easily clamped to the work surface. Movement of the locking mechanism is pivotal and results in a leveraged lesser movement of the first jaw or second jaw for a stronger clamping force.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and are not intended to limit the scope of the present disclosure. The inventive concepts associated with the present disclosure will be more readily understood by reference to the following description in combination with the accompanying drawings wherein.

DESCRIPTION OF THE ENABLING EMBODIMENTS

Example embodiments will now be described more fully with reference to the accompanying drawings. In general, the subject embodiments are directed to a locking assembly for securing portable electronic devices to a work surface. However, the example embodiments are only provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring to the Figures, wherein like numerals indicate corresponding parts throughout the views, the locking assembly is intended to provide a design that is hard to circumvent and is also compatible with a variety of portable electronic devices.

Figure 11:
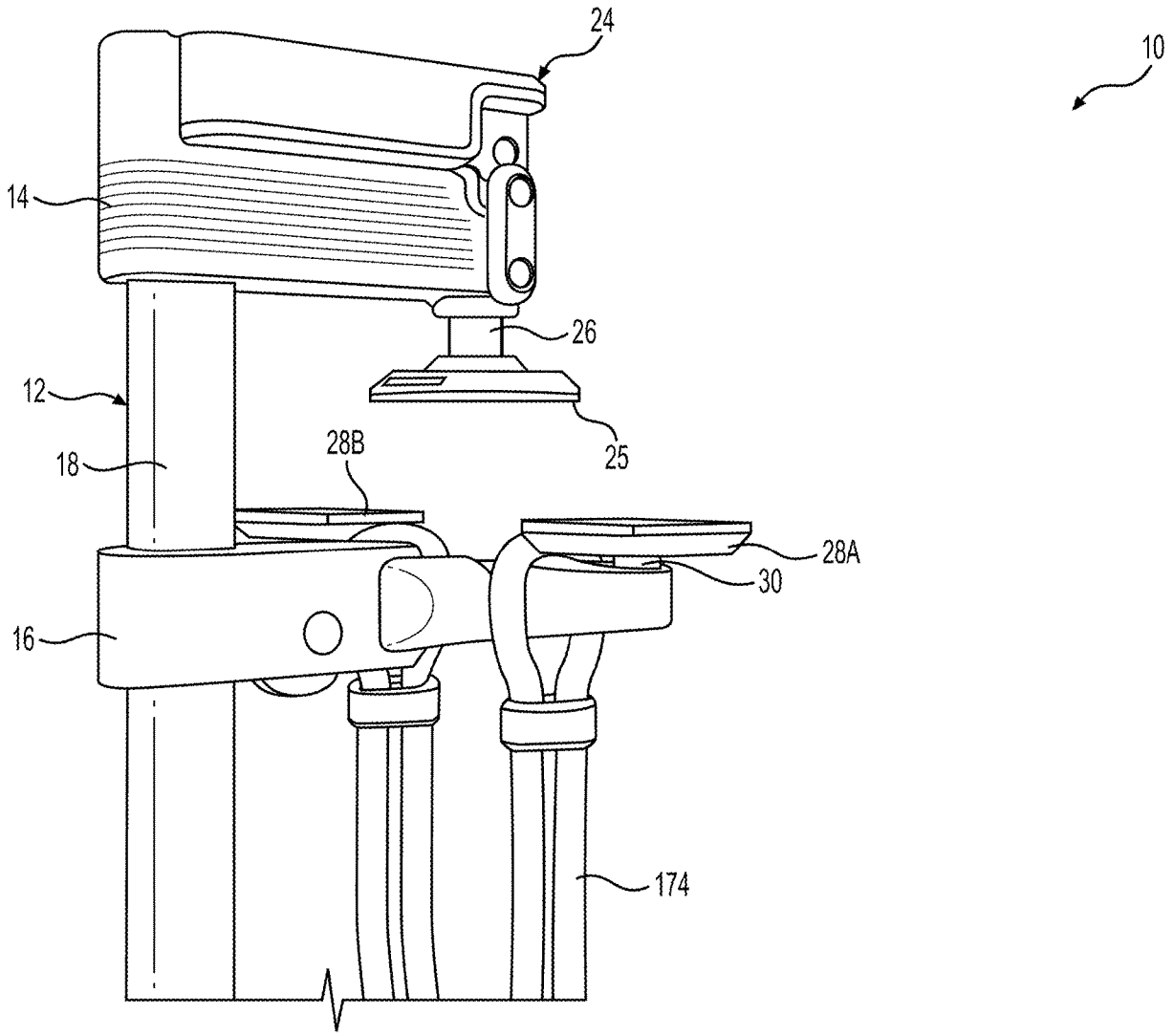
FIG. 11 is a second embodiment of the locking assembly including a first upper pad and a pair of second lower pads that are provided to clamp on either side of the work surface.

A locking assembly 10 in accordance with a first embodiment is generally shown in FIGS. 1-6. The locking assembly 10 comprises a clamp assembly 12 that includes a first jaw 14 and a second jaw 16 movable towards one another along an elongated bar 18 that extends axially between a first end 20 and a second end 22. In the illustrated embodiment, the first jaw 14 is stationary on the first end 20 of the elongated bar 18 and the second jaw 16 is movable along the elongated bar 18 between the second end 22 and a location in close proximity to the first jaw 14. However, the second jaw 16 could be stationary, while the first jaw 14 is movable along the elongated bar 18, without departing from the subject disclosure. The first jaw 14 extends from the elongated bar 18 to a first pad 25 disposed in a facing relationship with the second jaw 16. The first pad 25 connects to the first jaw 14 via a first pin 26 (as best illustrated in FIG. 11) that allows the first pad 25 to pivot relative to the first jaw 14. For example, the first pin 26 may allow pivotable or rotational movement between the first pad 25 and the first pin 26 with respect to at least one axis so that the first pad 25 remain parallel with the work surface if the locking assembly 10 is rocked back and forth. Alternatively, the first pin 26 may include a ball-type connection (not shown) allowing pivotable movement between the first pad 25 and the first pin 26 with respect to a plurality of axes. Similarly, the second jaw 16 extends from the elongated bar 18 to a second pad 28 disposed in a facing relationship to the first jaw 14. The second pad 28 connects to the second jaw 16 via a second pin 30 that allows the second pad 28 to move relative to the second jaw 16. The second pin 30 may be parallel to the first pin 26. For example, the second pin 30 may allow pivotable or rotational movement between the second pad 28 and the second pin 30 with respect to at least one axis so that the pads 25, 28 remain parallel with the work surface if the locking assembly 10 is rocked back and forth. It has been shown that maintaining the pads 25, 28 in a parallel position to the work surface can results in gripping forces of up to ten times as strong as non-parallel. The pads 25, 28 are preferable formed of rubber or other elastic materials that have a high friction index. In addition, the second pin 30 may include a ball-type connection (not shown) allowing pivotable movement between the second pad 28 and the second pin 30 with respect to a plurality of axes. In use, the first jaw 14 and second jaw 16 move relative to one another along the elongated bar 18 on opposite sides of a work surface, such as a table, a counter, or the like. As will be described in greater detail below, a locking mechanism 24 locks the first jaw 14 relative to the second jaw 16 once the pads 25, 28 have been positioned on and clamped to opposite sides of the work surface. The pads 25, 28 may be further configured to rotate with respect to the associated jaw 14, 16. For example, the first pin 26 and the second pin 30 illustrated in FIG. 11 may be rotatable relative to the associated jaw 14, 16 and also pivotally connected to the pads 25, 28 along the at least one axis that may be perpendicular or parallel to the pins 26, 30. The pivotal and rotational movement of the pads 25, 28 result in a nullification of the leverage by a potential thief when wiggling and prying at the locking assembly 10 as the pads 25, 28 remain relatively stationary and flush during torquing of the elongated bar 18 and/or jaws 14, 16.

Figure 1:
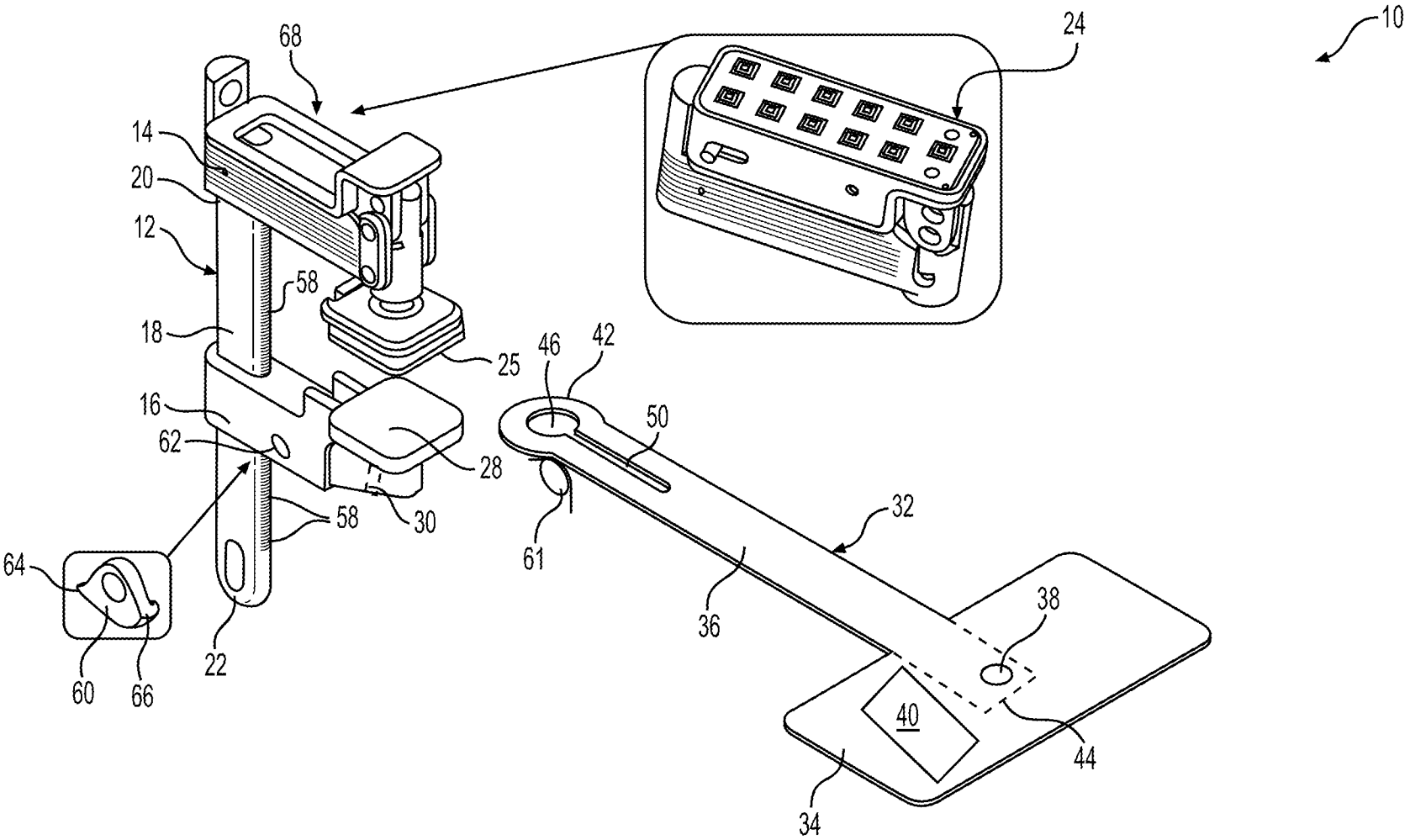
FIG. 1 is a perspective view of a locking assembly for locking a portable electronic device to a work surface according to a first embodiment of the invention.

With continued reference to FIG. 1, the locking assembly 10 further includes a connector 32 for connecting the clamp assembly 12 to the portable electronic device. More particularly, the connector 32 extends from a first connector end 42 pivotally connected to the clamp assembly 12 to a second connector end 44 for connection with the portable electronic device. In the preferred arrangement, the second connector end 44 establishes a pivotable connection with the portable electronic device (i.e., it is pivotably connected), to allow for a greater degree of freedom of the portable device about the work surface once the locking assembly 10 is secured thereto. However, other means of connecting the second connector end 44 to the portable electronic device could also be utilized without departing from the subject disclosure, some of which are described in more detail below.

For example, in the first embodiment, the connector 32 includes a connection plate 34 disposed adjacent the second connector end 44 and a connection strip 36 extending between the clamp assembly 12 from the first connector end 42 to the second connector end 44. The connection plate 34 is intended to be connected to the portable electronic device and the connection strip 36 is intended to be connected to the clamp assembly 12. The connection plate 34 and connection strip 36 may be integral or otherwise connected. The connection plate 34 and the connection strip 36 are preferably comprised of steel or other strong, semi-rigid materials. The connection strip 36 has a flat shape so that it is more rigid to deformation in certain directions, such as the directions in which it can pivot. In the illustrated embodiment, the connection plate 34 includes a pivot connector 38, such as a rivet, that pivotally connects a center of the connection plate 34 to the connection strip 36. The pivot connector 38 on the center of the connect plate 34 makes it more difficult to peel the connection plate 34 off of the connection strip 36 than if the pivot connector 38 was off center. The pivot connector 38 thus provides additional nullification to leveraging by a potential thief when wiggling and prying at the portable electronic device. The connection plate 34 may further include a portable electronic device connector 40, such as an adhesive, double-sided tape, and/or additional components. In instances with adhesive or double-sided tape, the device connector 40 may include a layer of tape primer on the surface of the portable electronic device (for example a 3M Primer 94). Research has shown that in scenarios wherein the connection plate 34 is steel and the laptop is plastic, utilizing primer on the laptop results the laptop being harder to peel off by over ten times than those without primer. The layer of primer between the portable electronic device and the adhesive or double-sided tape significantly increases the bond strength. For example, In use, the portable electronic device is connected to the connection plate 34, the connection plate 34 connects to the connection strip 36, and the connection strip 36 connects to the clamp assembly 12. The first connector end 42 includes a first bore 46 for connection to the clamp assembly 12 and the second connector end 44 includes a second bore 48 (FIG. 7) for connection to the pivot connector 38, e.g., the rivet, that extends along an axis. The connection strip 36 and/or the connection plate 34 may be formed of steel and/or steel alloys.

According to the first embodiment, the locking mechanism 24 locks the connection strip 36 to the first jaw 14 and only permits removal upon unlocking of the locking mechanism 24, e.g., via entry of a password or use of a key. More particularly, when the locking mechanism 24 is locked, a portion of the locking mechanism 24 extends through the first bore 46 and the first bore is large enough to permit the connector strip 36 to pivot thereabout to form a first pivot connector about a first axis. The connector 36 extends from the locking mechanism 24 to the rivet 38 to form a second pivot connector about a second axis that is parallel to the first. When the locking mechanism 24 is unlocked, it no longer extends through the bore 50 and the connection strip 36 can be removed. The pair of pivot connectors thus nullify misalignment of the pads 25, 28 that may be caused during an attempted theft.

Figure 2:
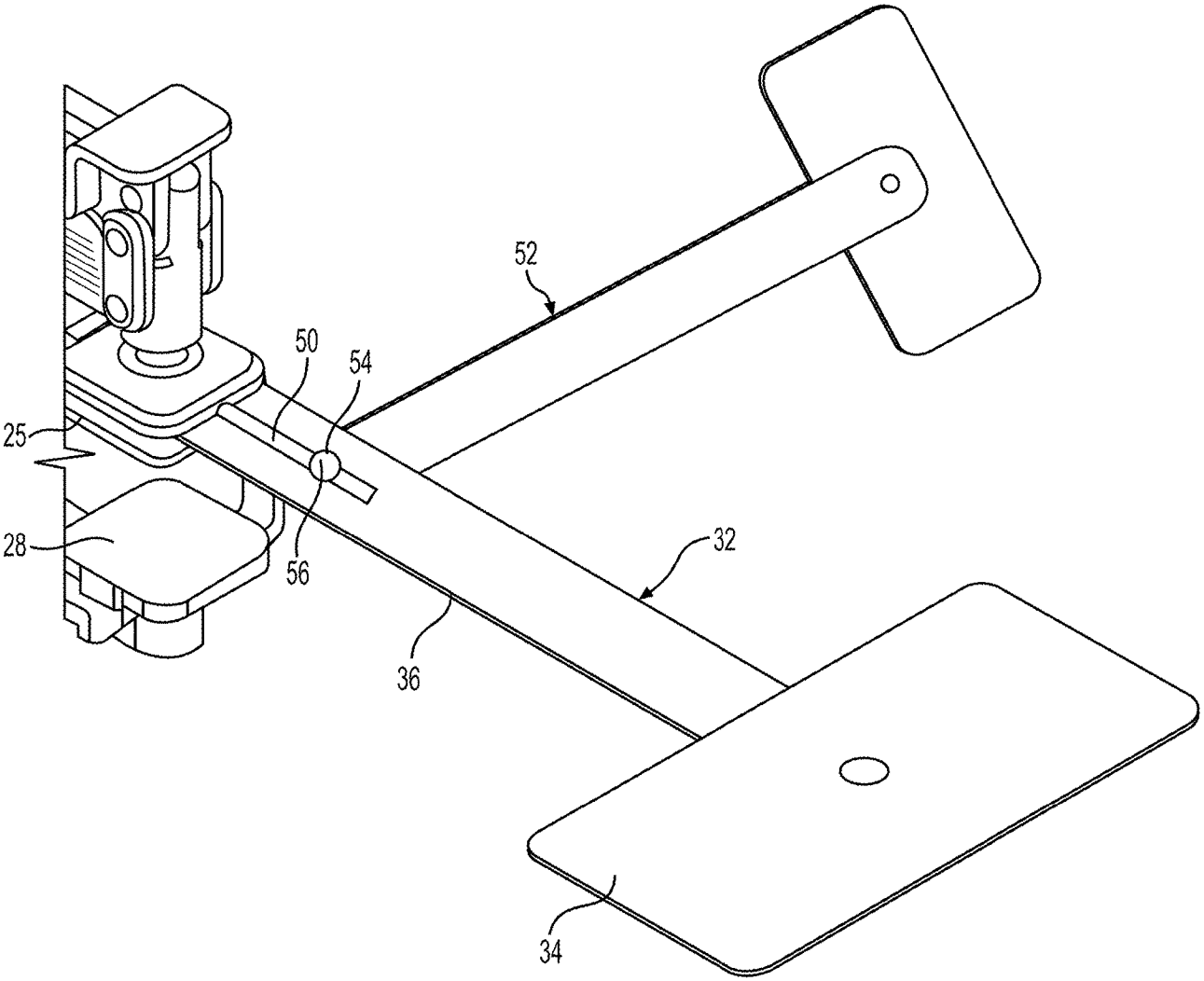
FIG. 2 is another perspective view of the locking assembly illustrating more than one portable electronic device being secured thereto.

With reference now to FIG. 2, the first bore 46 of the connection strip 36 (as best shown in FIG. 1) includes a slot 50 extending therefrom that allows for the connection of at least one add-on connector 52. More particularly, the add-on connector 52 can be primarily the same as connection strips 36 except that the first bore 46 is replaced with a connection pin 54 that extends to a flange 56. In use, the flange 56 is placed through the first bore 46 and the connection pin 54 is slid into the slot 50 such that it cannot be removed unless it is returned to the first bore 46. As will be appreciated in view of the continued description below, when the connector 32 is connected to the clamp assembly 12 and the clamp assembly 12 is clamped around the work surface, the first bore 46 becomes inaccessible such that the add-on connector 52 in the slot 50 cannot be removed.

Figure 3:
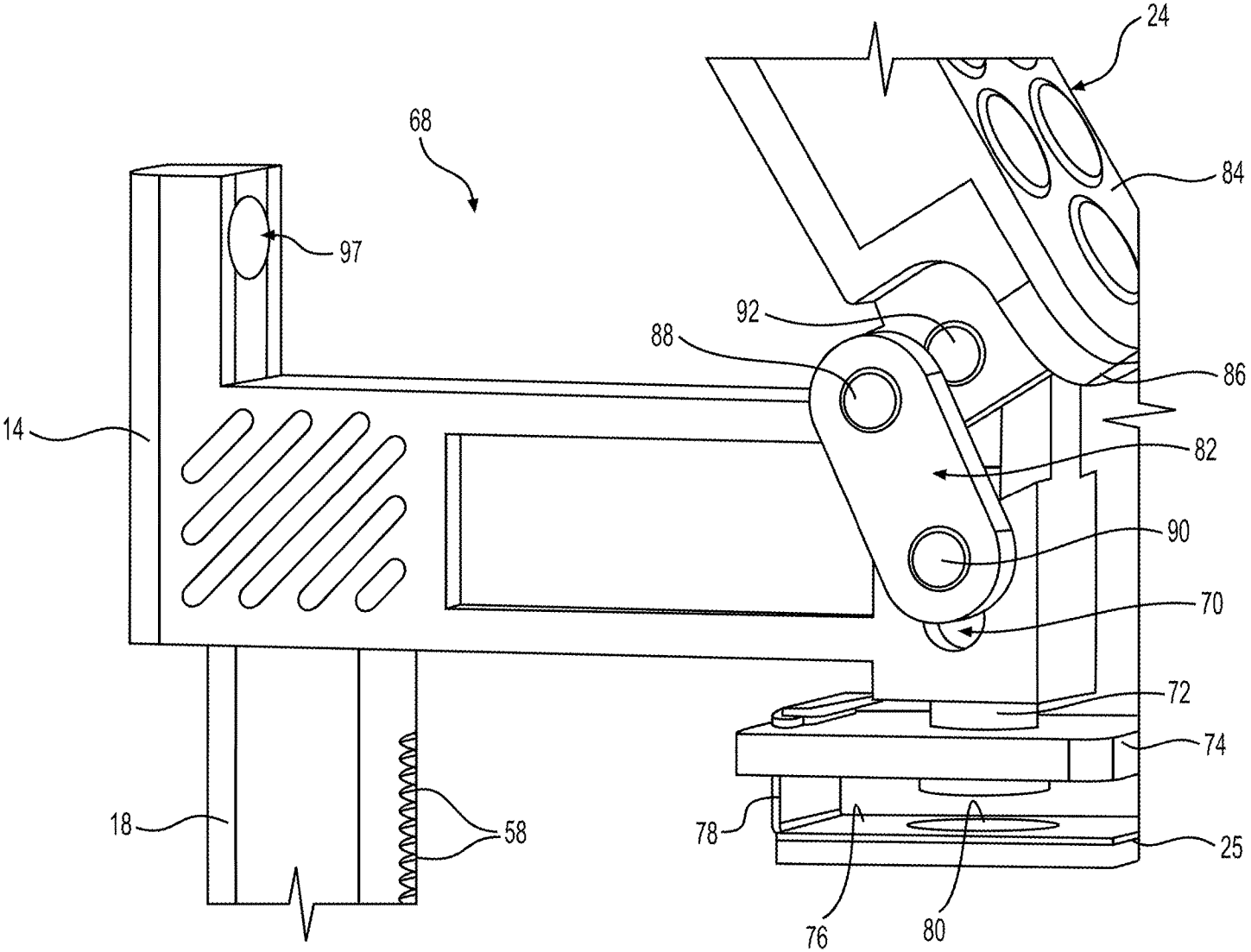
FIG. 3 is a side view of a locking mechanism of the locking assembly disposed in an open position to allow the portable electronic device can be removed therefrom.

As best illustrated in FIGS. 1 and 3, in one arrangement, the elongated bar 18 may include a plurality of teeth 58 along an edge thereof. Each of the teeth 58 may be triangularly shaped and extend at opposite angles from the edge, for example 45°, such that adjacent teeth form 90° angles with one another. The second jaw 16 includes a cog 60 pivotally connected thereto via a pin 62. The cog 60 includes a detent 64 and a release trigger 66. As such, as the second jaw 16 is moved towards the first jaw 14, the detent 64 interfaces with the plurality of teeth 58, causing the cog 60 to pivot. However, the detent 64 cannot freely move along the teeth 58 as the second jaw 16 is moved away from the first jaw 14 so that it becomes locked unless the release trigger 66 is actuated to pivot the detent 64 away from the plurality of teeth 58. The cog 60 may be biased towards the plurality of teeth 58 by a torsion spring 61. When the first jaw 14 and second jaw 16 are clamped on either side of the work surface, pressure on the second jaw 16 may prevent use of the release trigger 66. Use of the release trigger 66 can become available again upon de-clamping via movement of the locking mechanism 24, which will be described in greater detail below. However, it should be appreciated that other methods of locking the first jaw 14 and the second jaw 16 may be adopted including methods that do not necessarily require teeth and instead rely on locking levers or screws as is known in the art.

With continued reference to the first embodiment, certain components of the locking mechanism 24 are best illustrated in FIG. 3. The first jaw 14 defines a seat 68, having a u-shape, for placing the locking mechanism 24. The first jaw 14 further defines a cavity 70 for placement of a locking rod 72 that is movable with respect to the first pad 25. The locking rod 72 may extend along an axis that is parallel to the axis of the rivet 38. The locking rod 72 is connected to and extends at least partially through a back plate 74 that is generally parallel and adjacent to a top surface 76 of the first pad 25, the top surface 76 facing opposite the second pad 28. Instead of a first pin 26, a bracket 78 connects the first pad 25 to the first jaw 14 and allows some pivotal movement of the first pad 25 with respect to the first jaw 14. The top surface 76 defines a depression 80 that is sized to at least partially receive the locking rod 72. In operation, actuation of the locking mechanism 24 causes the back plate 74 to move into and out of contact with the top surface 76 of the first pad 25 and the locking rod 72 to move into and out of the depression 80. Before the locking rod 72 enters the depression 80, the first bore 46 of the connection strip 36 can be aligned therewith so that the locking rod 72 extends through the first bore 46 before being locked against the top surface 76 and into the depression 80 to form another pivot connector parallel to the first. As such, the connector strip 36 become pivotally connected to the first jaw 14 and the locking mechanism 24.

With continued reference to FIG. 3, the locking mechanism 24 includes a linkage 82 that pivotally connects the locking mechanism 24 to the first jaw 14. More particularly, the locking mechanism 24 includes a lock housing 84 and a carriage 86, wherein the carriage 86 is connected to both the linkage 82 and the lock housing 84. The linkage 82 includes a first pivot connection 88 connected to the carriage 86 and a second pivot connection 90 connected to the locking rod 72, while the carriage 86 includes a lock pivot 92 that pivotally connects the carriage 86 to the first jaw 14. The linkage 82 allows the carriage 86 and lock housing 84 to move or pivot between a locked position and an unlocked position. In the locked position, the carriage 86 and at least part of the lock housing 84 are located within the seat 68 of the first jaw 14 and the locking rod 72 is pushed into contact with the first pad 25 via operation of the linkage 82. In the open position, the carriage 86 is pivoted away from the first jaw 14 with respect to the lock pivot 92, causing the linkage 82, which is located closer to the elongated bar 18, to be pulled upwardly by the first pivot connection 88 and to carry or drag the locking rod 72 by the second pivot connection 90. Movement of the carriage 86 results in movement of the first jaw 14 or the second jaw 16 into forceful contact with the work surface. Movement of the carriage 86 results in a leveraged lesser movement (which may be bending or flexing) of the first jaw 14 or second jaw 16 by a ratio of approximately 40:1. As such, the leveraged movement results in a tighter clamping force that can quickly be established.

Figure 4:
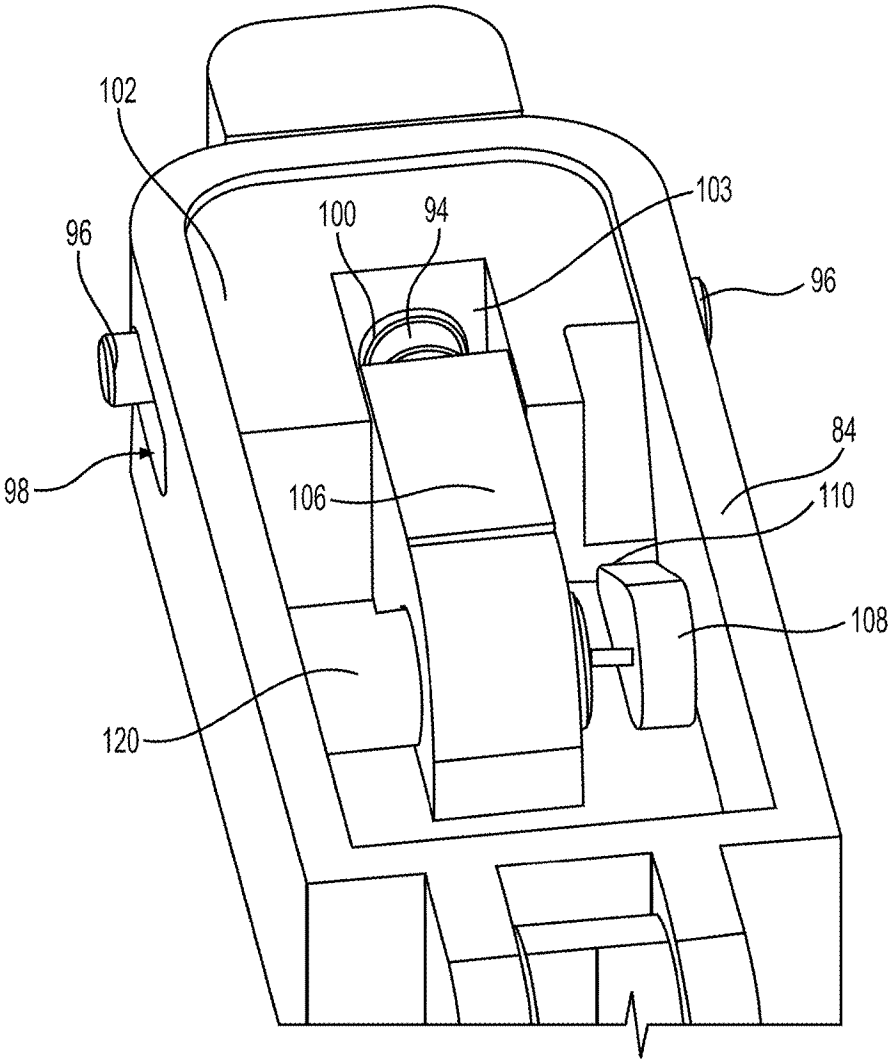
FIG. 4 is an internal view of the locking mechanism illustrating components that move a bolt between a locked and an unlocked position.

With reference now to FIG. 4, a disassembled view of the lock housing 84 is illustrated. The lock housing 84 contains a deadbolt arrangement that includes a bolt 94 that is located near the elongated bar 18 and is permitted to slide out of and retract into the lock housing 84. The first jaw 14 further includes a bolt port 97 (FIG. 3) along the seat 68 and aligned to receive the bolt 94 in a locked position, preventing pivotal movement of the lock mechanism 24 and the corresponding release of the locking rod 72. A pair of carrier pins 96 are located on opposite sides of the bolt 94 and extend through carrier slots 98 in the lock housing 84. In use, the carrier pins 96 can be manually slid along the carrier slots 98 to move the bolt 94 into and out of engagement with the bolt port 97. A spring 100 biases the bolt 94 in the locked position. Movement of the bolt 94 is guided by a guide block 102 that houses at least a portion of the bolt 94 and the pair of carrier pins 96. The first jaw 14 further includes a guide opening 104 (FIG. 5) for placement of the track block 106 that can be located therein. The guide block 102 includes a groove 103 that interfaces with the track block 106 and limits movement of the guide block 102 to only or substantially only axial movement. A lock tab 108 is pivotally connected to the lock housing 84 and is located near the guide block 102 and includes a lock surface 110. During operation, the lock tab 108 can be rotated such that the lock surface 110 blocks the return of the bolt 94 in a contact position, such that the bolt 94 is maintained in the locked position and cannot be retracted manually. The lock tab 108 can further be rotated to a non-contact position that permits the bolt 94 to be retracted. Rotational movement of the lock tab 108 can be effectuated by any number of means, however, in the illustrated embodiment it is effectuated by a motor 120.

Figure 5:
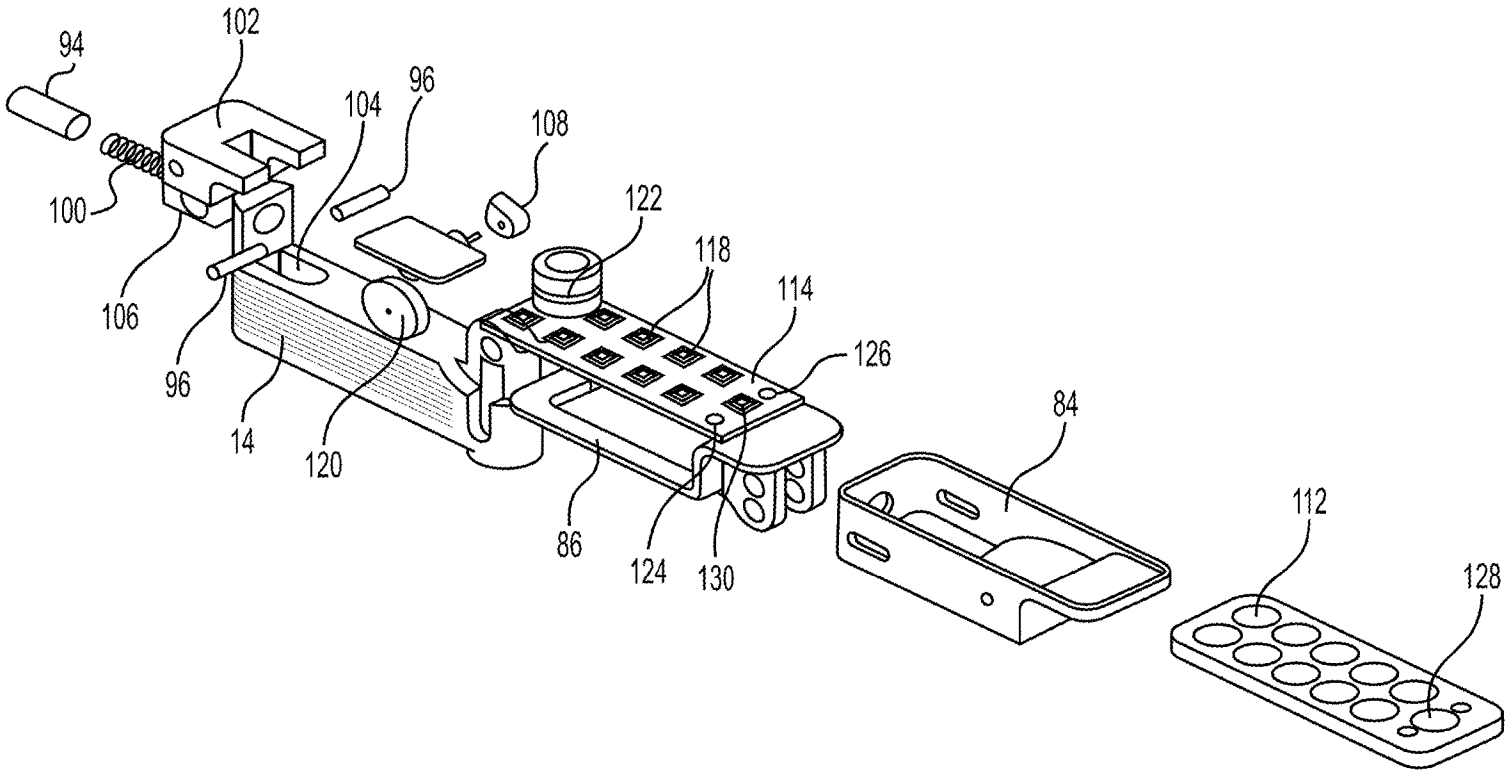
FIG. 5 is an exploded perspective view of the locking mechanism illustrating electronic components that facilitate moving the bolt between the locked and the unlocked positions.

With reference now to FIG. 5, the lock mechanism 24 includes a user interface such as a keypad 112 with a plurality of keys that cover an upper portion of the lock housing 84. A printed circuit board (PCB) 114 is located beneath the keypad 112 and includes a lock assembly circuit 116 (FIG. 6) that will be described in greater detailed below, and which includes a plurality of switches 118 corresponding to the keys. The motor 120 is connected to the lock assembly circuit 116 and causes the lock tab 108 to pivot the locking surface 110 into and out of engagement with the guide block 102. One or more batteries 122 are located within the lock housing 94 and provide power to the lock assembly circuit 116 and the motor 120. The lock assembly circuit 116 may further include one or more lights, such as LEDs, to indicate the status of the lock tab 108 and/or bolt 94. For example, a green light 124 to indicate that the lock surface 110 of the lock tab 108 is not engaged with the guide block 102 and thus is free to retract. A red light 126 may also be included to indicate engagement of the lock tab 108, thus requiring a password input with the key pad 112. In addition to the plurality of keys, the keypad 112 may also include a lock/unlock button 128 and the lock assembly circuit 116 may further include a lock/unlock switch 130, such that the lock/unlock button 128 needs to be pressed before or after inputting the password to effectuate movement of the lock tab 108.

Figure 6:
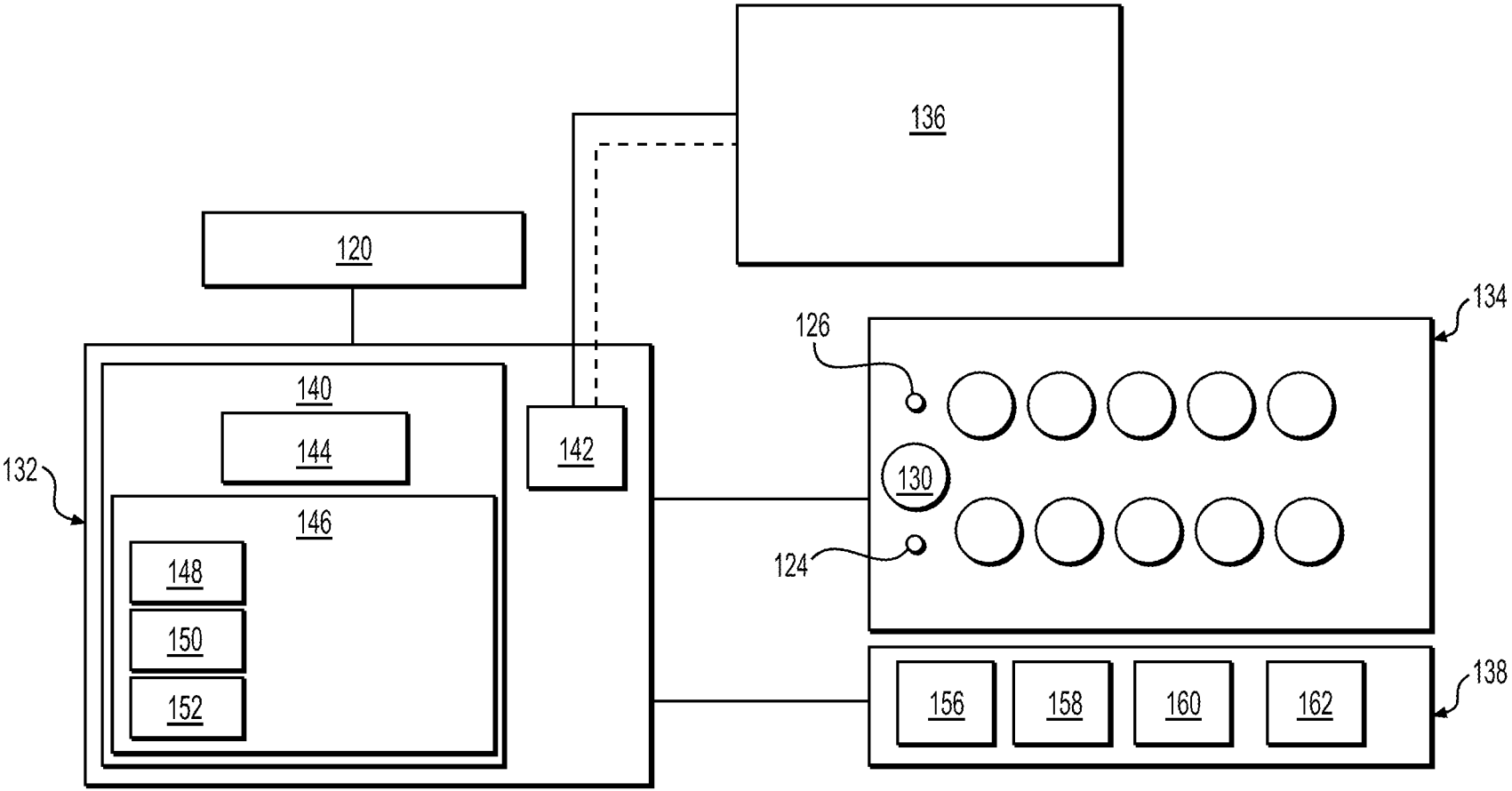
FIG. 6 is a schematic view of a lock assembly circuit that permits operation of the electronic components of the locking mechanism.

The lock assembly circuit 116 is schematically illustrated in FIG. 6 in accordance with one aspect of the disclosure. The various elements provided therein allow for a specific implementation. Thus, one of ordinary skill in the art of electronics and circuits may substitute various components to achieve a similar functionality. The lock assembly circuit 116 includes a General Computing Unit "GCU" system 132, a first user interface system 134 (corresponding to the keypad 112), a second user interface system 136, and an alarm circuit 138.

In accordance with one aspect, certain operations of the lock assembly circuit 116 can be controlled via communication between the first user interface 134 and the GCU system 132. The GCU system 132 includes a controller 140 and a communications module 142. The controller 140 includes a processor 144 and a memory 146 having machine readable non-transitory storage. Programs and/or software 148 (such as Arduino IDE, Windows, Linux, Android, iOS) may be saved on the memory 146 and so is an input data 150 obtained via the first user interface 134 and/or the second user interface system 136. Profile data 152 related to saved user preferences, such as passwords (password data) are also saved on the memory 146. The processor 144 translates and carries out instructions based on the software 148, input data 150, and profile data 152 and causes the motor 120 to move the lock tab 108 between positions.

The communications module 142 may provide a wireless connection (such as Wi-Fi or Bluetooth) from the GCU system 132 to the second user interface system 136, which may include a portable electronic device. For example, the communications module 142 may pair to a laptop and/or cellphone being secured to the locking mechanism 24. As such, while a laptop is left unattended, the processor may cause a notification to be sent to the cellphone in the event of movement, unlocking, and/or breaking. The alarm circuit 138 is configured to provide an auditory or other sensory alarm in the event of movement, unlocking, and/or breaking of the locking assembly 10. The alarm circuit 138 may include a piezo-type buzzer 156 (sensory alarm) for providing an auditory alert, a potentiometer 158, an accelerometer 160, and/or other movement detectors 162.

Figure 7A:
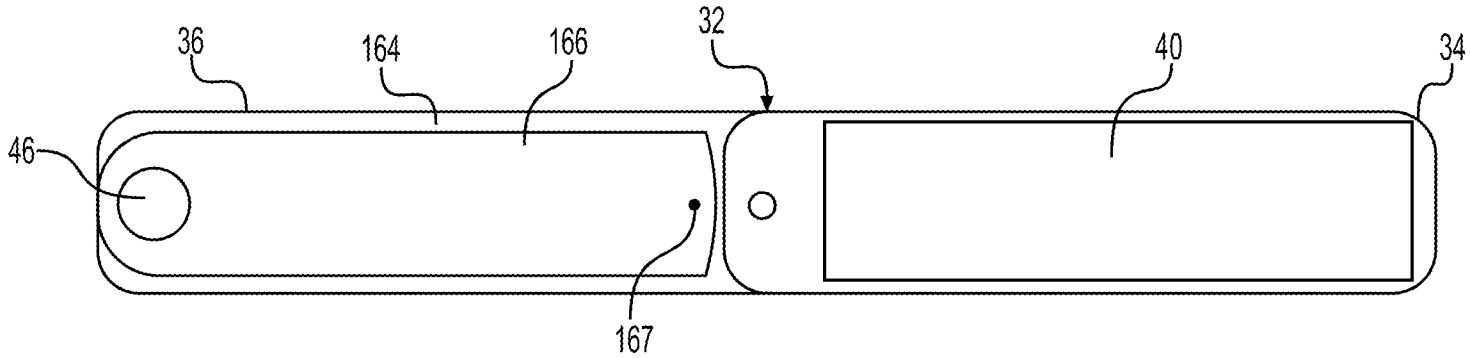
FIG. 7A is bottom view of an example implementation of an alarm system for the locking assembly including a circuit loop that becomes broken upon movement of the portable electronic device.
Figure 7B:
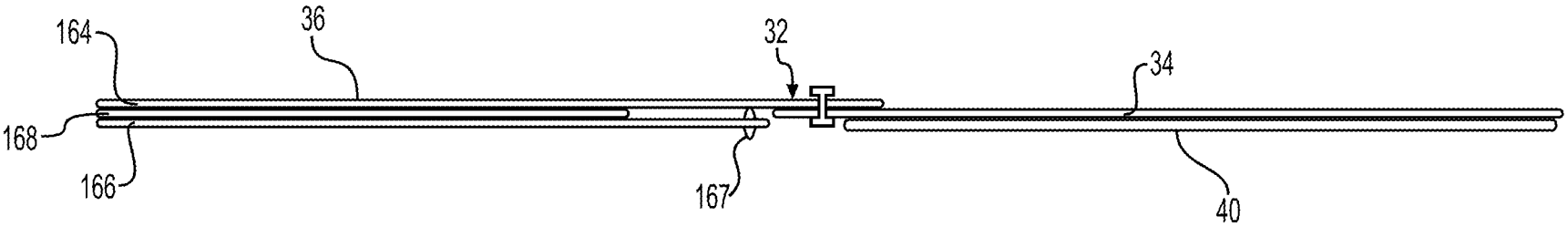
FIG. 7B is a side view of the alarm system illustrated in FIG. 7A.

One example implementation of the alarm circuit 138 is shown in FIGS. 7A and 7B, in which the connection strip 36 includes a first conductive layer 164 spaced from a second conductive layer 166 by an insulator 168 (as best illustrated in FIG. 7B). A contact 167 extends from the first conductive layer 164 and contacts the second conductive layer 164 to complete a circuit loop. The first conductive layer 164 is pivotally connected to the connection plate 34 and the second conductive layer 166 is spaced from the pivot connection. As such, when the connection strip 36 flexes up or down or is twisted along its length, the contact 167 becomes spaced from the first conductive layer 164, cutting the circuit loop, and the alarm circuit 138 is caused to initiate the alarm.

Figure 8:
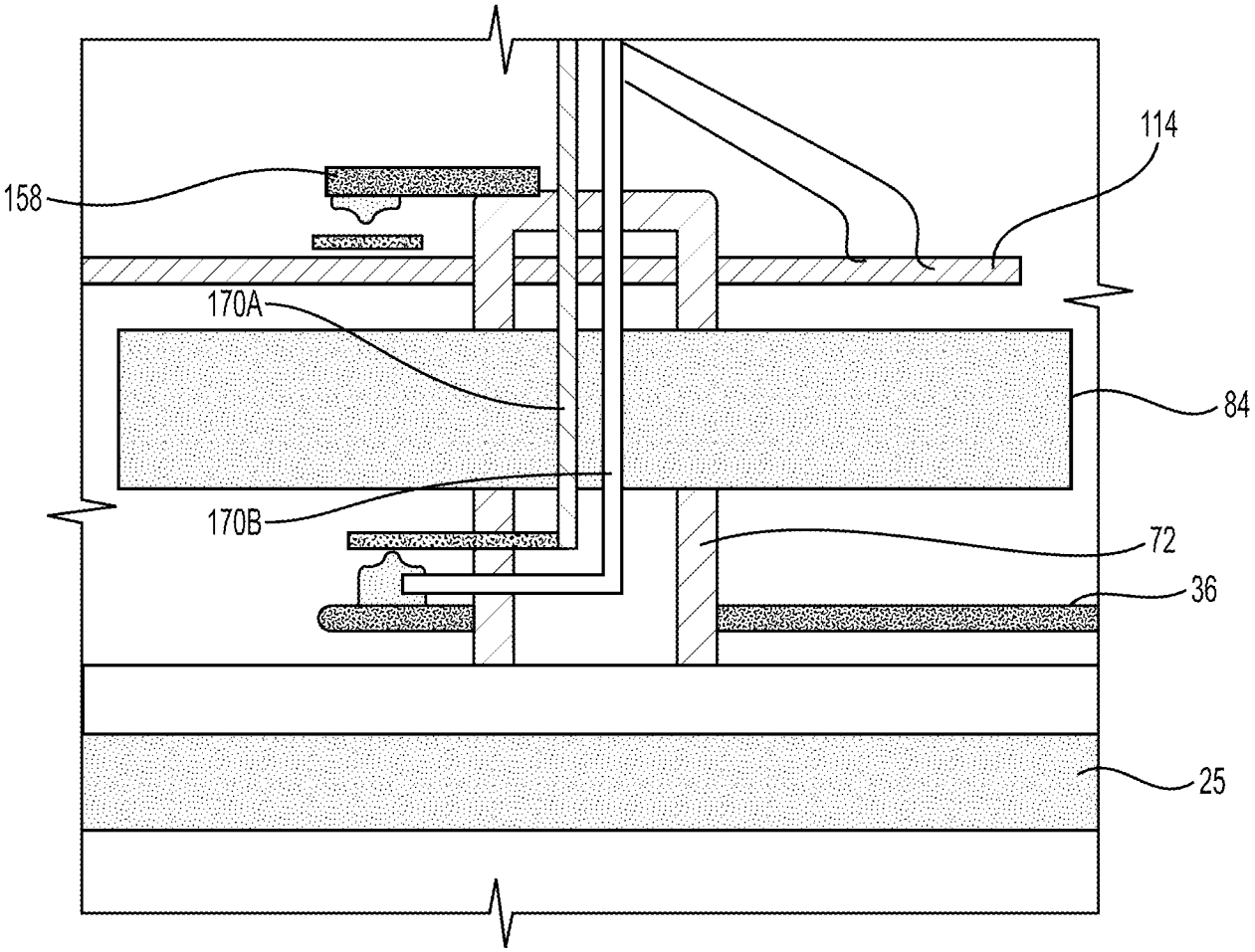
FIG. 8 is another example implementation of an alarm system for the locking assembly including a potentiometer that senses movement of the portable electronic device.

Another example implementation of the alarm circuit 138 is shown in FIG. 8, in which the potentiometer 158 is located within the lock housing 84 and includes a pair of electrical contacts 170 that contact one another on the connection strip 36. For example, the pair of electrical contacts 170 may include a first contact (170A) that extends from the alarm circuit 138 and is fixed to the connection strip 36 and a second contact (170B) that extends from the potentiometer 158 and electrically connects to the first contact when the connection strip 36 is in specific positions. As such, as the connection strip 36 is moved, the electric connection between the pair of electrical contacts 170 is broken, initiating the alarm circuit 138.

Figure 9:
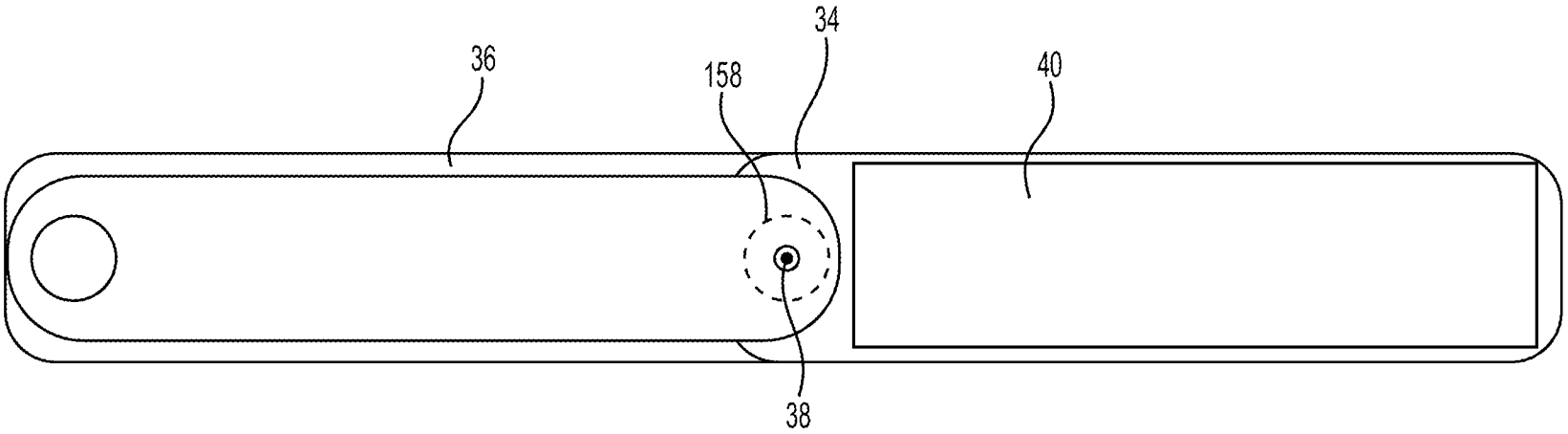
FIG. 9 is yet another implementation of an alarm system for the locking assembly including a potentiometer that senses pivotal movement of the portable electronic device.

Another example implementation of the alarm circuit 138 is shown in FIG. 9, in which wherein the potentiometer 158 is located on or near the rivet 38 that pivotally connects the connection plate 34 to the connection strip 36. As such, a predetermined amount of rotation or pivoting of the connection plate 34 with respect to the connection strip 36 initiates the alarm circuit 138.

Figure 10:
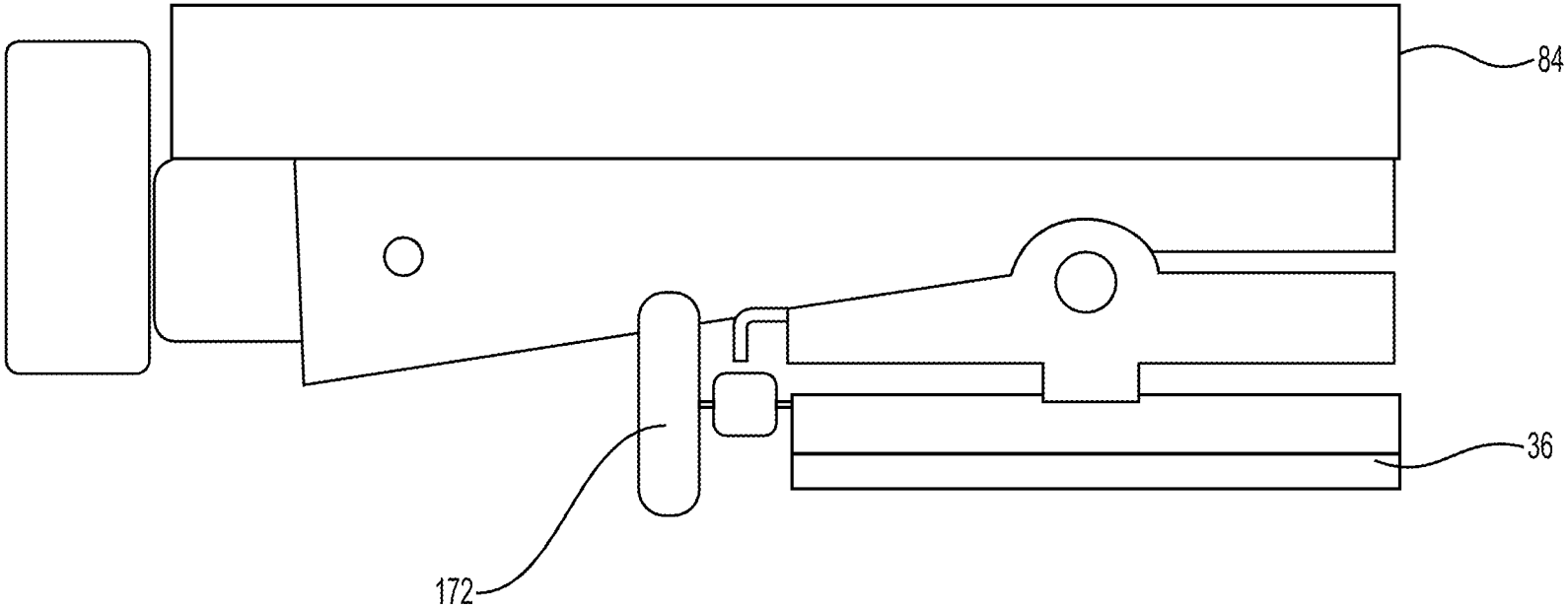
FIG. 10 is another implementation of an alarm system for the locking assembly including a rotary-type detector that senses movement of the portable electronic device.

Yet another implementation of the alarm circuit 138 is illustrated in FIG. 10, in which the movement detector 162 includes a rotary-type detector 172 that contacts a center of the connection strip 36 and/or connected work surface and signals to the alarm circuit 138 after a predetermined distance of rotation.

The implementations of the alarm circuit illustrated 138 in FIGS. 7 through 10 are provided for the purpose of example and are not meant to be limiting. Each of the implementations may be used together or separate. In addition, it should be appreciated that the initiation of the alarm circuit 138 may be caused by certain instructions saved in memory 146 and executed by processor 144. For example, the instructions saved in memory 146 may only allow the processor to cause the alarm circuit 138 to initiate once the password has been entered and the locking assembly 10 is in the locked position. Moreover, any predetermined distances or threshold values may be saved on memory 146. It should also be appreciated that the input data 150 obtained via the first user interface 134 and/or the second user interface system 136 may allow a user to alter predetermined thresholds and/or which of the various alarm implementations in FIGS. 7 through 10 are to be turned on or off.

With reference now to FIG. 11, a second embodiment of the locking assembly 10 is illustrated and may include all of the features provided in the first embodiment. However, the second embodiment of the locking assembly 10 further includes a pair of second pads 28A, 28B (instead of just a single second pad 28, as in the first embodiment) and a cable 174, that is metal or otherwise reinforced, to loop around each of the second pads 28A, 28B. Other belongings, such as a purse, can thus be secured to the cable 174 (i.e., the cable 174 can be passed through handles of the purse) before connection to the second pads 28A, 28B and clamping to the work surface.

Figure 12:
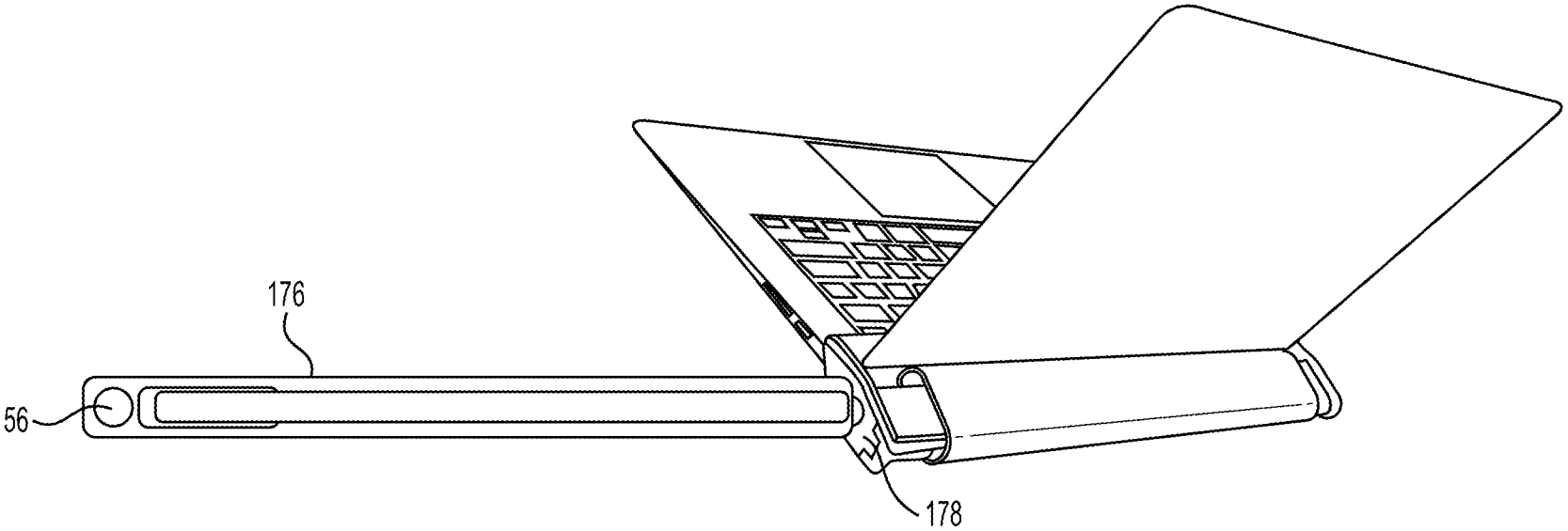
FIG. 12 is a third embodiment of the locking assembly including a connection key for direct connection to the portable electronic device.

With reference now to FIG. 12, a third embodiment of the locking assembly 10 is illustrated and which may include all of the features provided in the first and second embodiments. However, the third embodiment further includes a modified connection plate, i.e., a connection key 176, that may be used in conjunction with or independently of the previously described connection strip 36. The portable electronic device includes a keyway 178, such as a Kensington slot, and the connection key 176 can be locked therein. The connection key 176 may be a cable or metal strip and include one of the previously described connection pins 54 to be located in the slot 50 of the connection strip 36. Alternatively, the connection key 176 may include the previously described pivot connector 38, e.g., rivet, for permanent connection to the connection strip 36. Removal of the connection key 176 may be via an electronic lock, mechanical lock, or other mechanisms as described herein.

Figure 13A:
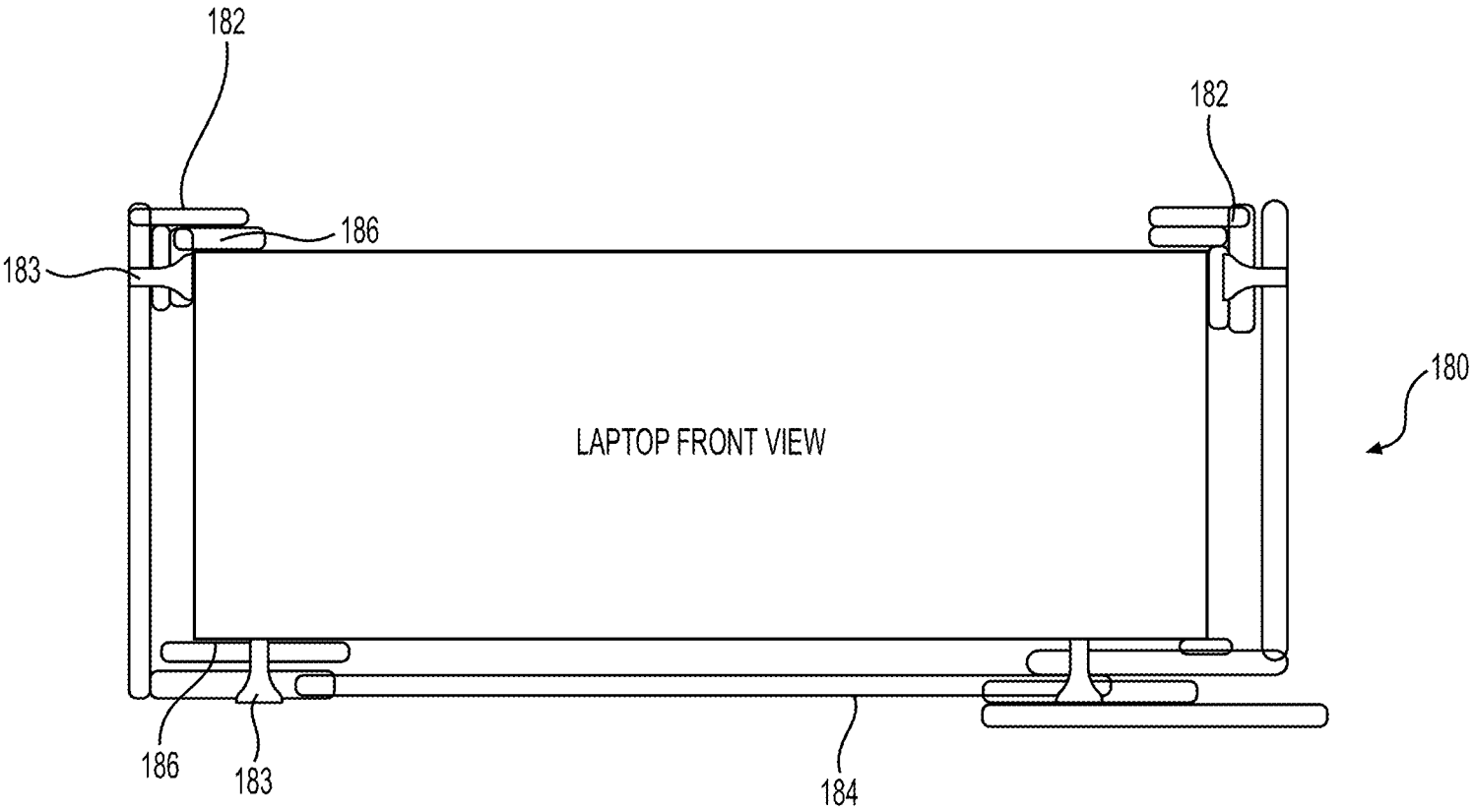
FIG. 13A is a front view of a fourth embodiment of the locking assembly including a plurality of adjustable clamps.
Figure 13B:
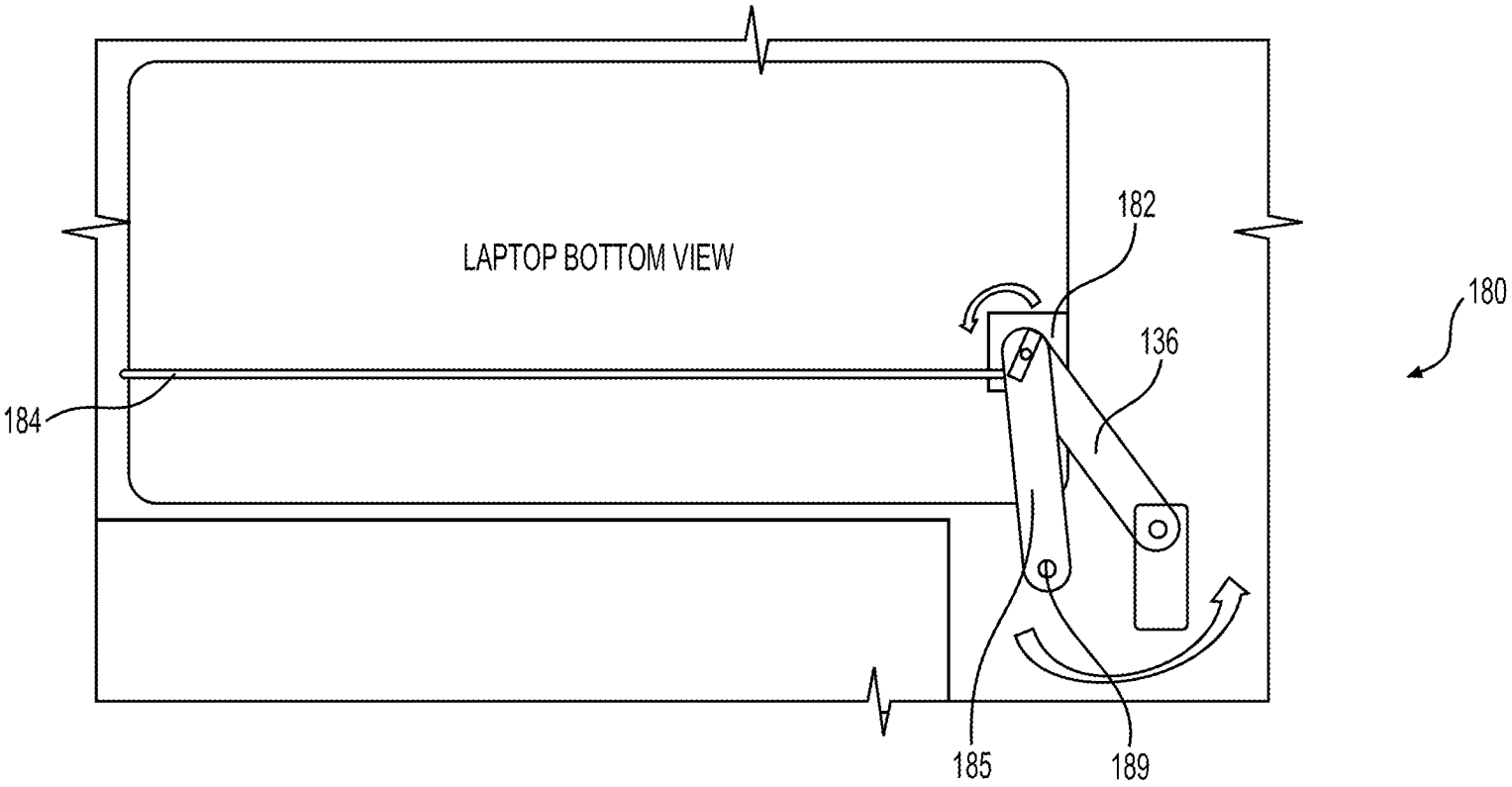
FIG. 13B is a bottom view of the fourth embodiment of the locking assembly.

FIGS. 13A and 13B illustrates a fourth embodiment of the locking assembly 10 which may include all of the features provided in the previous embodiments. However, the fourth embodiment further includes a modified connection plate, i.e., a connection bracket 180, which includes a plurality of adjustable clamps 182 connected to one another via a band 184. In operation, the adjustable clamps 182 can be secured around various locations of the portable electronic device and connected to each other via the band 184, which can be connected to the connection strip 36. Elastic buffers 186 may be connected to each adjustable clamp 182 for an improved connection that prevents scratching to the portable electronic device. Bolts 183 may be located on the adjustable clamps 182 for further tightening the elastic buffers 186 against the portable electronic device. As shown in a bottom view of the fourth embodiment illustrated in FIG. 13B, the band 184 may be a metal cable and a tightening arm 185 is connected to the band 184 and pivotally connected to the first jaw 14 or second jaw 16 so that as it pivots it tightens the band 184, whereafter it can be locked against the first jaw 14 or second jaw 16 until the cable needs to be released. Alternatively, the tightening arm 185 may include an opening 189 for receiving the rivet 38 on the connection strip 36.

Figure 14:
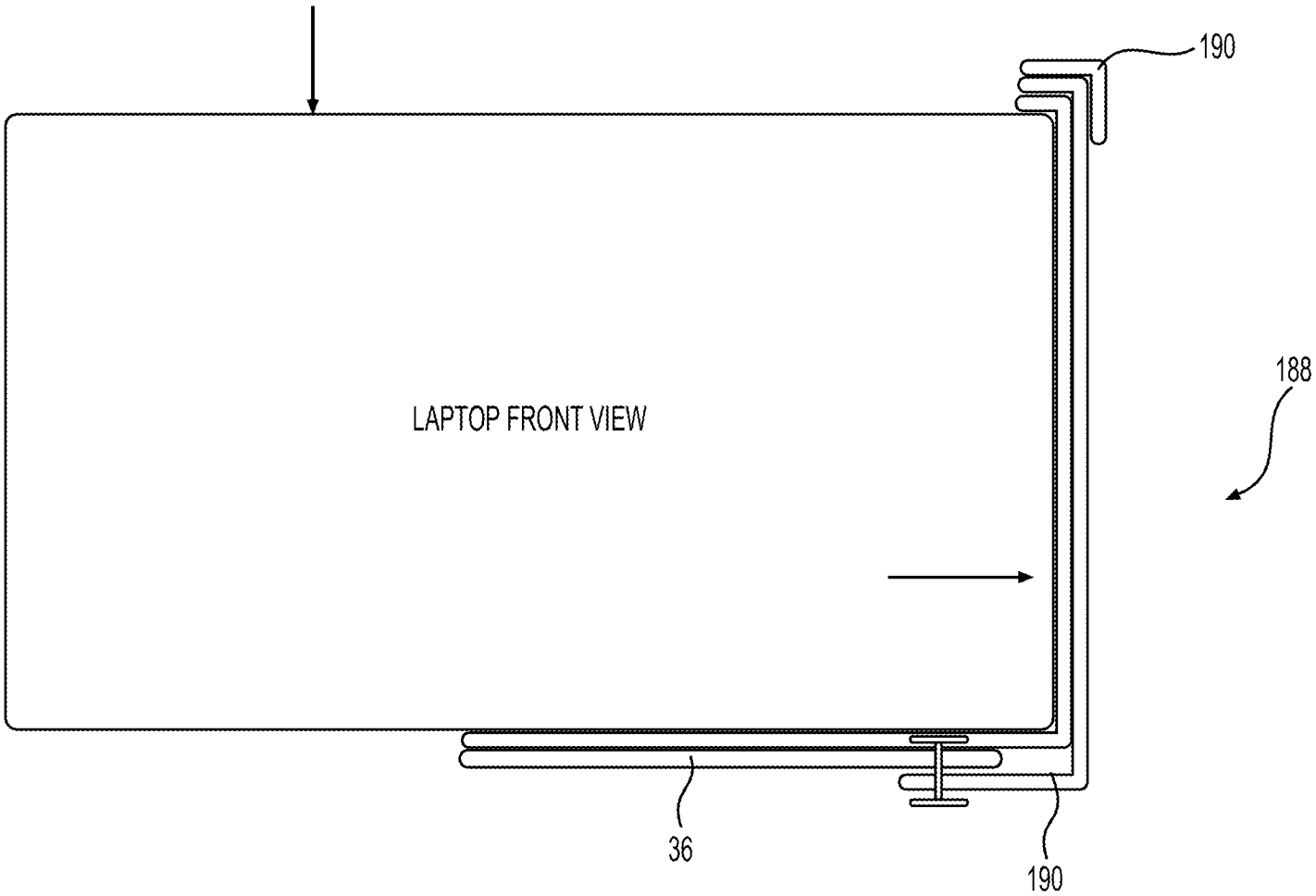
FIG. 14 is a fifth embodiment of the locking assembly including a corner clamp for connection to the portable electronic device.

FIG. 14 illustrates a fifth embodiment of the locking assembly 10, which may include all of the features provided in the previous embodiments. However, the fifth embodiment further includes a modified connection plate, i.e., a corner clamp 188, which includes a pair of corner jaws 190 for mounting to vertically offset corners of a laptop or other portable electronic devices. The clamp 188 may further include one of the previously described connection pins 54 to be located in the slot 50 of the connection strip 36. Alternatively, the corner clamp 188 may include the previously described pivot connector 38, e.g., rivet, for permanent connection to the connection strip 36.

Figure 15A:
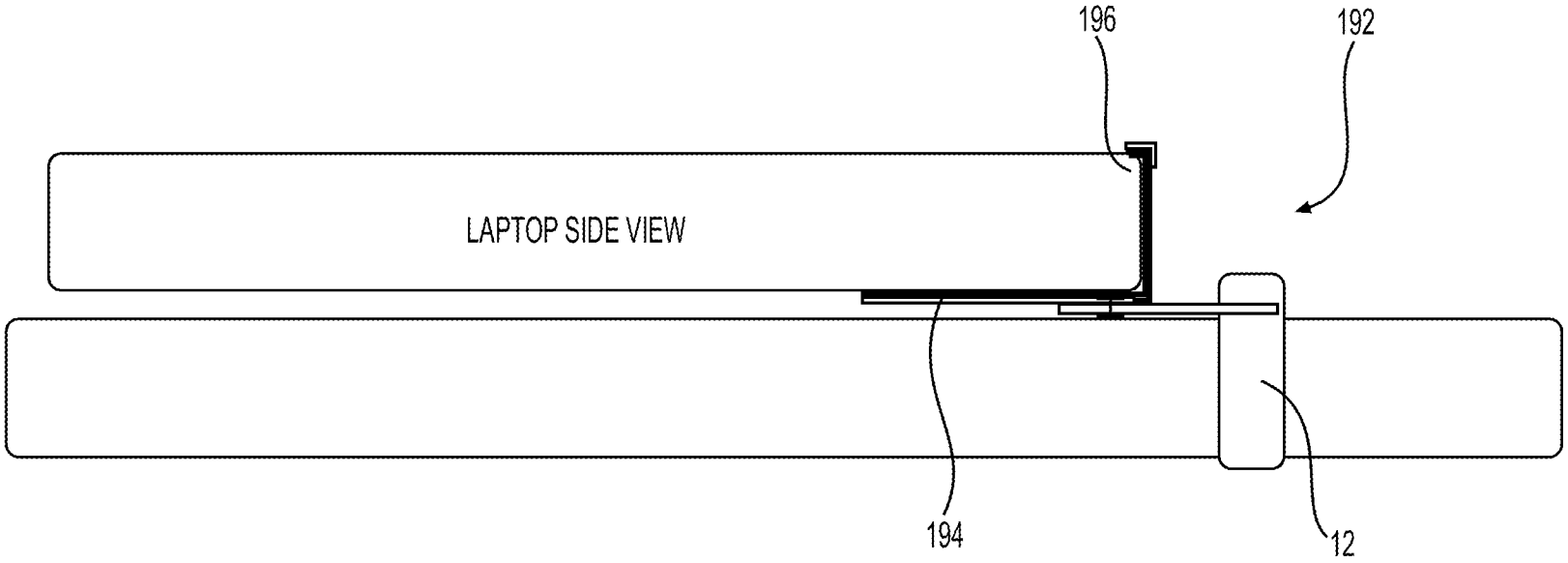
FIG. 15A is a side view of a sixth embodiment of the locking assembly including a connection panel assembly for connection to the portable electronic device.
Figure 15B:
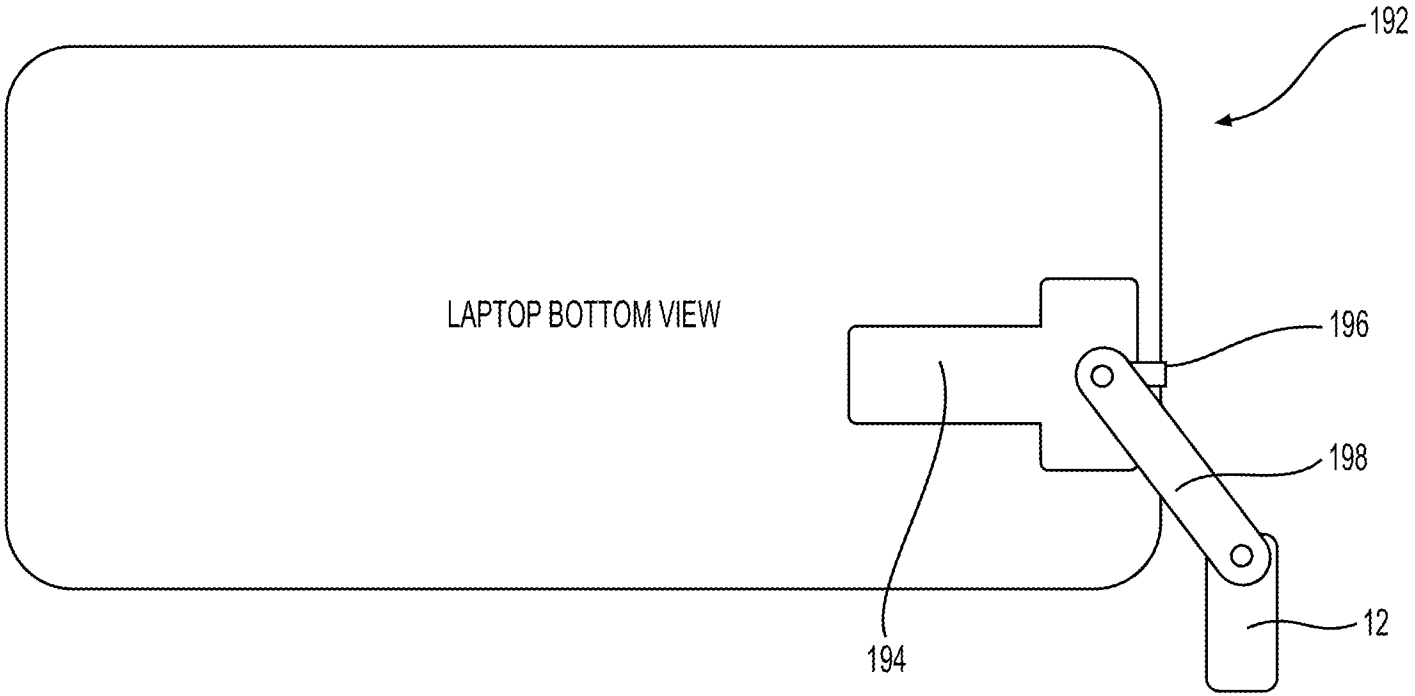
FIG. 15B is a bottom view of the sixth embodiment of the locking assembly.

FIGS. 15A and 15B illustrate a sixth embodiment of the locking assembly 10, which may include all of the features provided in the previous embodiments. However, the sixth embodiment includes a smaller clamp assembly 12 and further includes a modified connection plate, i.e., a connection panel assembly 192, which includes a connection panel 194 for placement on the bottom of the portable electronic device that is pivotally connected to a side clamp 196 to clamp the panel 194 to the portable electronic device. A panel linkage 198 (best shown in FIG. 15B) extends between and pivotally connects to the panel 194 and pivotally connects to the clamp assembly 12.

Figure 16B:
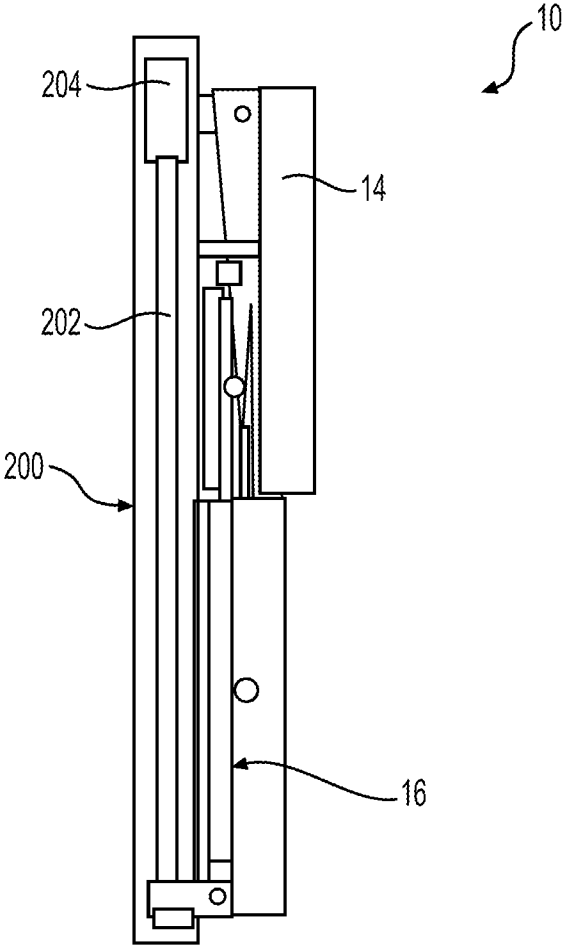
FIG. 16B is the seventh embodiment of the locking assembly in a folded position that facilitates transportation.
Figure 16A:
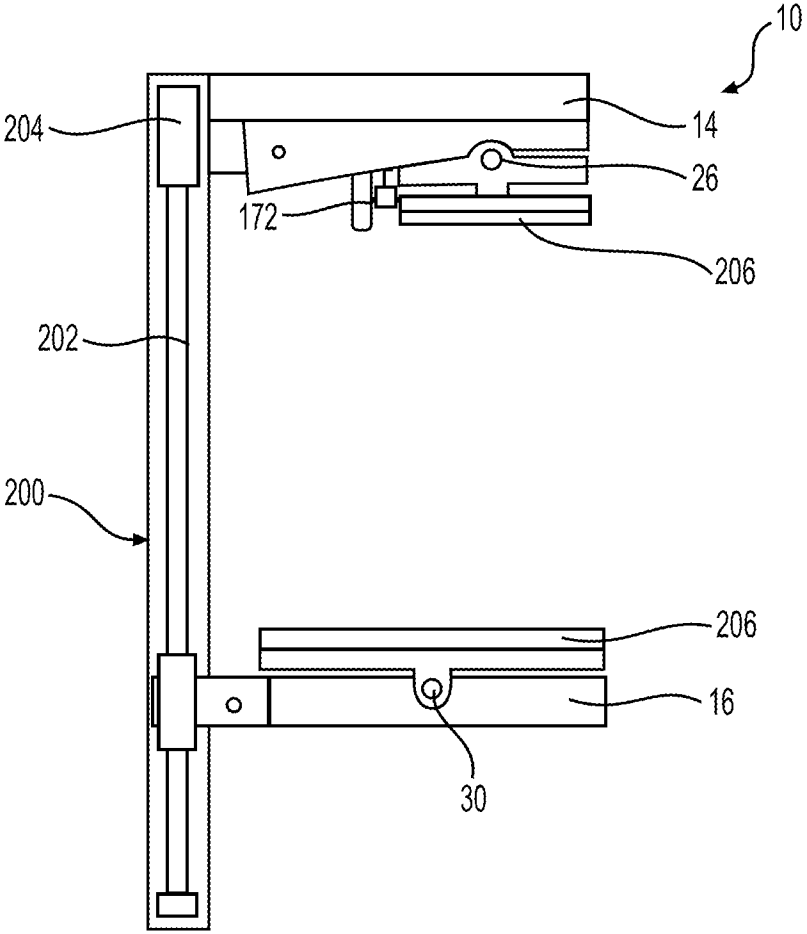
FIG. 16A is a seventh embodiment of the locking assembly including a motorized elongated bar for driving a clamp assembly between a clamped and an unclamped position.

FIGS. 16A and 16B illustrate a seventh embodiment of the locking assembly 10, which may include all of the features provided in the previous embodiments. However, the seventh embodiment further includes a modified elongated bar, i.e., a motorized elongated bar 200, which includes a lead screw 202 and a lead screw motor 204 located adjacent to the first jaw 14 to drive the lead screw 202 to rotate. The second jaw 16 is connected to the lead screw 202 and moves during rotation of the lead screw 202. The first jaw 14 and second jaw 16 are both pivotally connected to the motorized elongated bar 200 so they can be pivoted against the motorized elongated bar 200 for easy transportation (as best shown in FIG. 16B). As illustrated, the rotary-type detector 172 is located near the first jaw 14. In addition, the seventh embodiment includes a pair of rectangular pads 206 instead of the first pad 25 and second pad 28 for a larger contact area with the portable electronic device.

Figure 17:
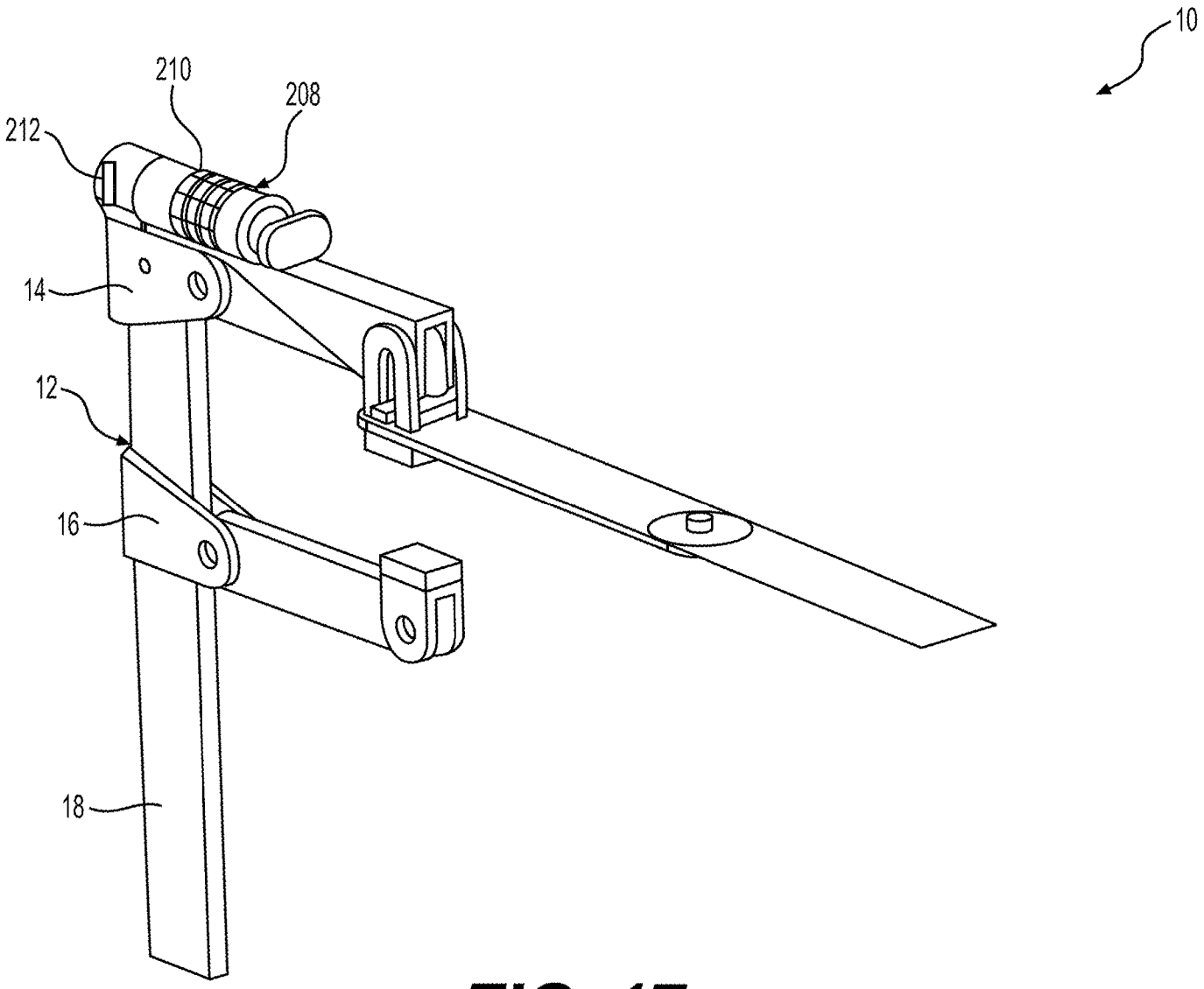
FIG. 17 is an eighth embodiment of the locking assembly including a manual lock housing for manually moving the bolt between the unlocked and locked positions.

FIG. 17 illustrates an eighth embodiment of the locking assembly 10, which may include all of the features provided in the previous embodiments. However, the eighth embodiment further includes a modified lock housing, i.e., a manual lock housing 208. Instead of the electronic components, the manual lock housing 208 includes a manual combination lock 210 and/or a keyway 212. More particularly, the manual lock housing 208 may include a dial-type lock that can be unlocked by aligning a series of dials into a pre-established combination. The manual lock housing 208 can thus be locked again by inserting a male portion (not shown) into the lock housing 208 and rotating the series of dials until they are no longer in the pre-established combination.

Figure 18:
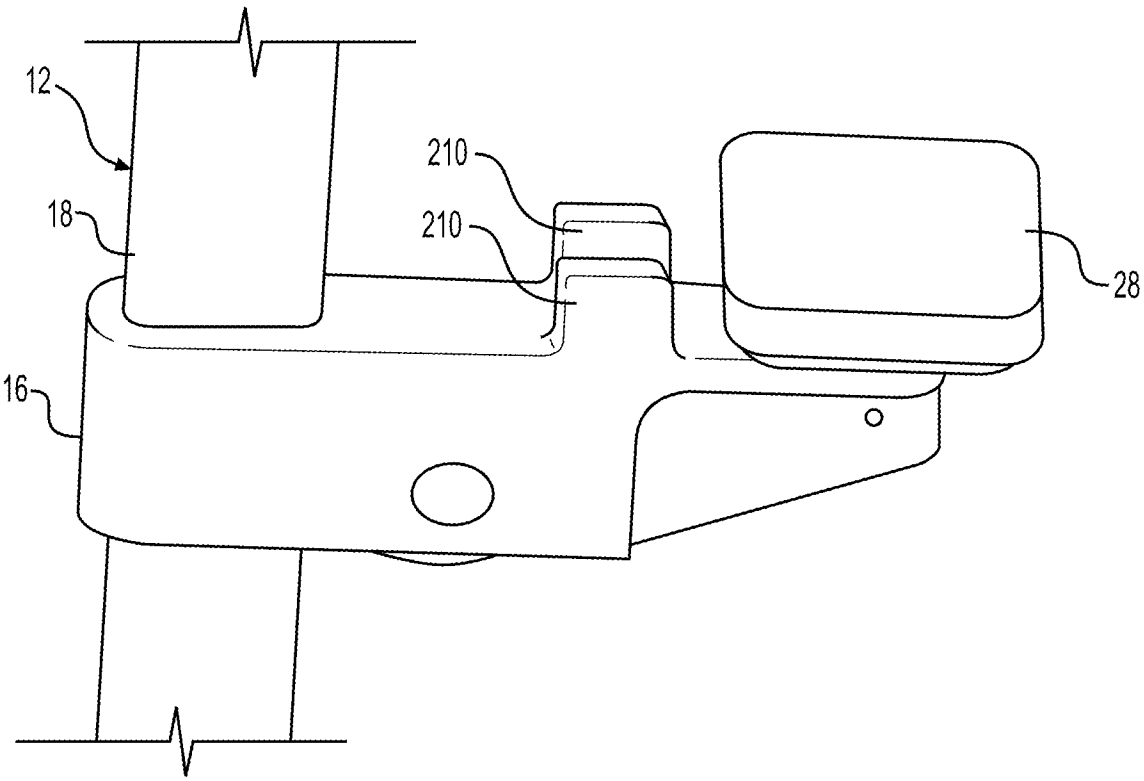
FIG. 18 is a ninth embodiment of the locking assembly including a pair of pins for holding a cable that can attach additional personal belongings to the locking assembly.

FIG. 18 illustrates a ninth embodiment of the locking assembly 10, which may include all of the features provided in the previous embodiments. However, the ninth embodiment further includes a modified bottom jaw 16, i.e., a bottom jaw 16 that includes a pair of pins 210 configured to hold the cable 174 (FIG. 11). More particularly, the cable 174 can loop around each of the pins 210 similar to how it was looped around respective second pads 28A, 28B in the second embodiment. Each pin 210 may be sized to extend the same or similar vertical distance of the second pad 28, such that the cable cannot be removed from pins 210 until the second jaw 16 has been loosened and spaced from the work surface.

It should be appreciated that the foregoing description of the embodiments has been provided for purposes of illustration. In other words, the subject disclosure it is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varies in many ways. Such variations are not to be regarded as a departure from the disclosure, and all such modifications are intended to be included within the scope of disclosure.

What is claimed is:

1. A locking assembly for locking a portable electronic device to a work surface, the locking assembly comprising:

a clamp assembly including a bar extending between a first end and a second end for placement adjacent to the work surface;

the clamp assembly further including a first jaw and a movable jaw extending outwardly from the bar in spaced relationship to one another, the moveable jaw being moveable along the bar between the first and second ends for clamping a work surface between the first and moveable jaws;

a locking mechanism operably interconnected to the movable jaw and interchangeable from an unlocked condition wherein the movable jaw is freely movable along the bar to a locked condition wherein the movable jaw is prevented from moving along the bar to selectively lock the relative positioning between the first jaw and the movable jaw; and a connector extending from a first connector end that is releasably connected to one of the clamp assembly or the locking mechanism in the locked condition to a second connector end for being connected to the portable electronic device to secure the portable electronic device to the work surface when the locking mechanism is disposed in the locked condition.

2. The locking assembly of claim 1, wherein the first connector end is pivotally connected to one of the clamp assembly or the locking mechanism at a first pivot connector about a first axis and wherein the second connector end includes a second pivot connector for being pivotally connected to the provided portable electronic device about a second axis.

3. The locking assembly of claim 2, wherein the first jaw extends from the bar to a first pad extending towards and facing the movable jaw and the movable jaw extends from the bar to a second pad extending towards and facing the first pad, and wherein a first pin pivotally connects the first pad to the first jaw and a second pin pivotally connects the second pad to the movable jaw to permit pivotal movement of the first and second pads relative to their respective first and movable jaws.

4. The locking assembly of claim 2, wherein the first axis is parallel to the second axis.

5. The locking assembly of claim 4, wherein the connector includes a connection strip extending between the first and second connector ends and a connection plate pivotably connected to the second connector end about the second pivot connector for establishing the pivotable connection between the portable electronic device and the connector.

6. The locking assembly of claim 5, wherein the connection plate includes adhesive or double-sided tape for securing the portable electronic device to the connection plate and wherein the second pivot connector is comprised of a rivet for permitting pivotal movement between the connection strip and the connection plate.

7. The locking assembly of claim 5, wherein the first pad and the second pad are each rotatable relative to the respective one of the first and movable jaw.

8. The locking assembly of claim 1, wherein the connector further includes a connection bracket having a plurality of adjustable clamps for connection to a plurality of different locations of the portable electronic device.

9. The locking assembly of claim 1, wherein the first jaw and movable jaw are foldable into a position substantially parallel to the bar.

10. The locking assembly of claim 1, further including a lead screw located in the bar and a lead screw motor for rotating the lead screw, wherein rotation of the lead screw by the lead screw motor moves the movable jaw.

11. The locking assembly of claim 1, wherein the first jaw includes a first pad in a facing relationship to the movable jaw and the movable jaw includes a pair of second pads in a facing relationship with the first jaw.

12. The locking assembly of claim 1, wherein the connector includes a connection key disposed on the second connector end and a keyway for connection to the portable electronic device, wherein the key and keyway can be selectively locked together to secure the portable electronic device to the clamp assembly.

13. The locking assembly of claim 1, wherein the locking mechanism is pivotably connected to the first jaw via a linkage and is pivotable relative to the first jaw between the locked and unlocked conditions.

14. The locking assembly of claim 13, further comprising:

the first jaw including a first pad disposed in facing relationship with the movable jaw;

the movable jaw including a second pad disposed in facing relationship with the first jaw; and wherein the locking mechanism is movable into abutting relationship with the first pad during transition from the unlocked condition to the locked condition for forcing the first jaw into forceful contact with the work surface and establishing a clamping force on the work surface between the first and movable jaws.

* * * * *